US009945332B2

(12) United States Patent
Roth

(10) Patent No.: US 9,945,332 B2
(45) Date of Patent: Apr. 17, 2018

(54) CONTROLLING EXHAUST GAS FLOW TO THE EGR SYSTEM THROUGH A SCAVENGER VALVE

(71) Applicant: BorgWarner Inc., Auburn Hills, MI (US)

(72) Inventor: David B. Roth, Groton, NY (US)

(73) Assignee: BorgWarner Inc., Auburn Hills, MI (US)

( * ) Notice: Subject to any disclaimer, the term of this patent is extended or adjusted under 35 U.S.C. 154(b) by 139 days.

(21) Appl. No.: 14/436,982

(22) PCT Filed: Oct. 14, 2013

(86) PCT No.: PCT/US2013/064783

§ 371 (c)(1),
(2) Date: Apr. 20, 2015

(87) PCT Pub. No.: WO2014/070427

PCT Pub. Date: May 8, 2014

(65) Prior Publication Data

US 2015/0260128 A1 Sep. 17, 2015

Related U.S. Application Data

(60) Provisional application No. 61/720,072, filed on Oct. 30, 2012.

(51) Int. Cl.

| | |
|---|---|
| ***F02M 25/07*** | (2006.01) |
| ***F02M 26/43*** | (2016.01) |
| ***F02D 13/02*** | (2006.01) |
| ***F02B 29/06*** | (2006.01) |
| ***F02M 26/07*** | (2016.01) |

(Continued)

(52) U.S. Cl.

CPC ..... *F02M 26/43* (2016.02); *F01N 13/107* (2013.01); *F02B 29/06* (2013.01); *F02D 13/0276* (2013.01); *F02M 26/05* (2016.02); *F02M 26/06* (2016.02); *F02M 26/07* (2016.02); *F02M 26/14* (2016.02); *F02M 26/42* (2016.02); *F01L 1/3442* (2013.01); *F01L 2001/34483* (2013.01); *F02B 29/04* (2013.01); *F02D 41/0047* (2013.01); *F02M 26/28* (2016.02)

(58) Field of Classification Search

CPC . F02D 13/0276; F02D 41/0047; F02M 26/04; F02M 26/07; F02M 26/09; F02M 26/10; F02M 26/14; F02M 26/17; F02M 26/42; F02M 26/43; F01N 13/107

USPC ..... 123/568.11, 568.12, 568.13, 568.2, 123/568.21

See application file for complete search history.

(56) References Cited

U.S. PATENT DOCUMENTS

2007/0175215 A1* 8/2007 Rowells ..... F02B 29/0418 60/605.2

2009/0223220 A1 9/2009 Vuk (Continued)

OTHER PUBLICATIONS

PCT/US2013/064783 Search Report and Written Opinion; dated Jan. 17, 2014; 14 pages.

(Continued)

*Primary Examiner* — Sizo Vilakazi
*Assistant Examiner* — Kevin R Steckbauer
(74) *Attorney, Agent, or Firm* — BrooksGroup

(57) ABSTRACT

One variation may include a method of controlling exhaust gas flow in an internal combustion engine system, and products and systems using same.

21 Claims, 5 Drawing Sheets

(51) Int. Cl.

| | |
|---|---|
| ***F02M 26/06*** | (2016.01) |
| ***F02M 26/42*** | (2016.01) |
| ***F01N 13/10*** | (2010.01) |
| ***F02M 26/05*** | (2016.01) |
| ***F02M 26/14*** | (2016.01) |
| *F02B 29/04* | (2006.01) |
| *F02M 26/28* | (2016.01) |
| *F01L 1/344* | (2006.01) |
| *F02D 41/00* | (2006.01) |

(56) References Cited

U.S. PATENT DOCUMENTS

| | | | | |
|---|---|---|---|---|
| 2009/0308070 | A1 | 12/2009 | Alger, II et al. | |
| 2011/0000470 | A1* | 1/2011 | Roth ..... | F02D 13/0249 123/568.11 |
| 2011/0303199 | A1 | 12/2011 | Vuk | |
| 2012/0073288 | A1 | 3/2012 | Ulrey et al. | |

OTHER PUBLICATIONS

Catalytic Converter; http://en.wikipedia.org/wiki/catalytic_converter; Dec. 14, 2011; 7 pages.
PCT/US09/34392 filed Feb. 18, 2009.
PCT/US2011/21846 filed Jan. 20, 2011.
Chinese Office Action dated Jun. 13, 2017 ; Application No. 201380053895.9; Applicant: BorgWarner Inc.; 13 pages.

* cited by examiner

CONTROLLING EXHAUST GAS FLOW TO THE EGR SYSTEM THROUGH A SCAVENGER VALVE

CROSS-REFERENCE TO RELATED APPLICATIONS

This application claims the benefit of U.S. Provisional Application Ser. No. 61/720,072 filed Oct. 30, 2012.

TECHNICAL FIELD

The field to which the disclosure generally relates includes methods of controlling flow of exhaust gases from an internal combustion engine.

BACKGROUND

Vehicles may include an exhaust gas recirculation system.

SUMMARY OF SELECT ILLUSTRATIVE VARIATIONS

One variation of the invention may include a method of controlling an internal combustion engine system, including communicating at least one blowdown exhaust valve from at least one cylinder connected to the exhaust subsystem to the exhaust subsystem via a blowdown manifold; communicating the scavenger valve of the at least one cylinder connected to the EGR system to the EGR subsystem; and communicating the EGR subsystem to the induction system.

Another variation of the invention may include an internal combustion engine system, including a turbocharged internal combustion engine including a plurality of cylinders, each having a blowdown exhaust valve and a scavenging exhaust valve wherein at least one cylinder is dedicated to an EGR subsystem and at least one cylinder is connected to an exhaust subsystem to carry exhaust gases away from the engine; an induction subsystem to deliver induction gases to the engine; wherein the exhaust subsystem carries exhaust gases away from the engine, and including a blowdown exhaust manifold in communication with the blowdown exhaust valves of the cylinders connected to the exhaust subsystem, and a scavenging exhaust manifold in communication with the scavenging exhaust valves of the cylinders connected to the exhaust subsystem; a turbocharging subsystem including a compressor in the induction subsystem and a turbine in the exhaust subsystem in communication with the blowdown exhaust manifold; and an exhaust gas recirculation (EGR) subsystem in communication with at least the scavenging valve of the dedicated EGR cylinder, the EGR subsystem in communication with the induction subsystem.

Other variations of the invention will become apparent from the detailed description provided hereinafter. It should be understood that the detailed description and specific examples, while disclosing variations of the invention, are intended for purposes of illustration only and are not intended to limit the scope of the invention.

BRIEF DESCRIPTION OF THE DRAWINGS

Variations of the invention will become more fully understood from the detailed description and the accompanying drawings, wherein.

DETAILED DESCRIPTION OF SELECT VARIATIONS

Figure 1A:
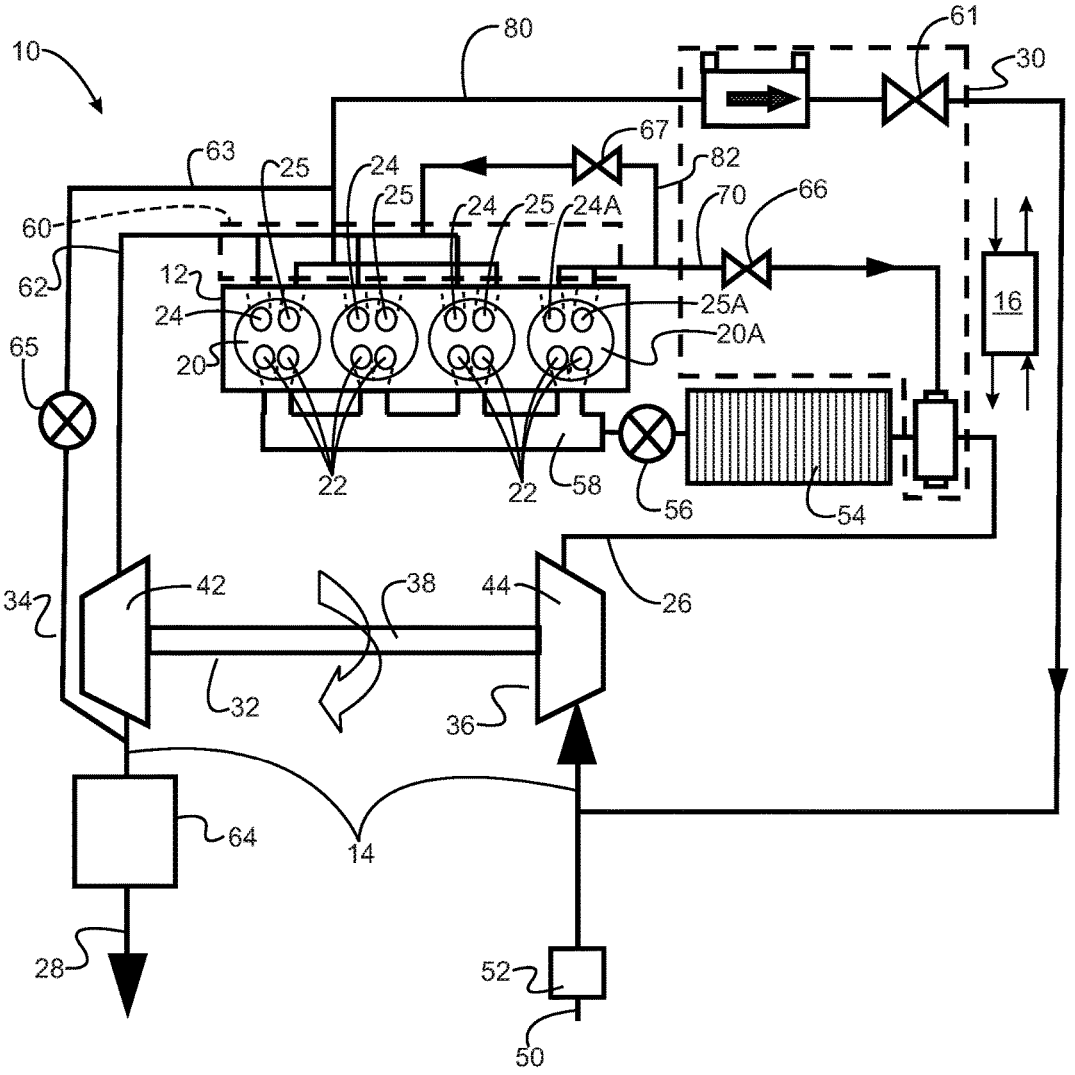
FIG. 1*a* is a schematic view of an internal combustion engine system according to one variation of the invention.

The following description of select variations of the invention is merely illustrative in nature and is in no way intended to limit the invention, its application, or uses.

Referring to FIG. 1, one variation may include a method that may be carried out using any suitable system and, more specifically, may be carried out in conjunction with an engine system such as system 10. The following system description simply provides a brief overview of one variation of an engine system, but other systems and components not shown here could also support the presently disclosed method.

In general, the system 10 may include an internal combustion engine 12 that may combust a mixture of fuel and induction gases for conversion into mechanical rotational energy and exhaust gases, an engine breathing system 14 that may deliver induction gases to the engine 12 and carry exhaust gases away from the engine 12. The system 10 may also include a fuel subsystem (not shown) to provide any suitable liquid and/or gaseous fuel to the engine 12 for combustion therein with the induction gases, and a control subsystem 16 to control operation of the engine system 10.

The internal combustion engine 12 may be any suitable type of engine, such as a spark-ignition engine like a gasoline engine, an auto-ignition or compression-ignition engine like a diesel engine, or the like. The engine 12 may include a block 18 with cylinders and pistons therein (not separately shown), which, along with a cylinder head (also not separately shown), may define combustion chambers 20 for internal combustion of a mixture of fuel and induction gases. The engine 12 may also include any suitable quantities of intake valves 22 and exhaust valves that may include any suitable number of first or blowdown exhaust valves 24 and second or scavenging exhaust valves 25.

The engine 12 may include any quantity of cylinders, and may be of any size and may operate according to any suitable speeds and loads. Illustrative idle speeds may be on the order of about 500 to about 800 RPM, and typical maximum engine speed may be on the order of about 5500-6500 RPM but may even exceed that range. As used herein, the term low speeds and loads may include about 0% to 33% of maximum engine speeds and loads, intermediate speeds and loads may include about 25% to 75% of maximum engine speeds and loads, and high speeds and loads may include about 66% to 100% of maximum engine speeds and loads. As used herein, low to intermediate speeds and loads may include about 0% to 50% of maximum engine speeds and loads, and intermediate to high speeds and loads may include about 50% to 100% of maximum engine speeds and loads.

Valve timing may be regulated by camshafts or valve solenoids or the like to open the valves. In an illustrative example of an engine cycle, an exhaust valve opens just before a piston reaches a bottom dead center (BDC) position and soon thereafter about half of all combusted induction gases exit the combustion chambers under relatively high pressure. This is commonly referred to as a blowdown phase of the exhaust portion of the engine cycle. The piston sweeps back upward toward a top dead center position (TDC) and displaces most if not all of the remaining combusted induction gases out of the combustion chambers under relatively lower pressure. This is commonly referred to as a scavenging phase of the exhaust portion of the engine cycle.

Figure 2:
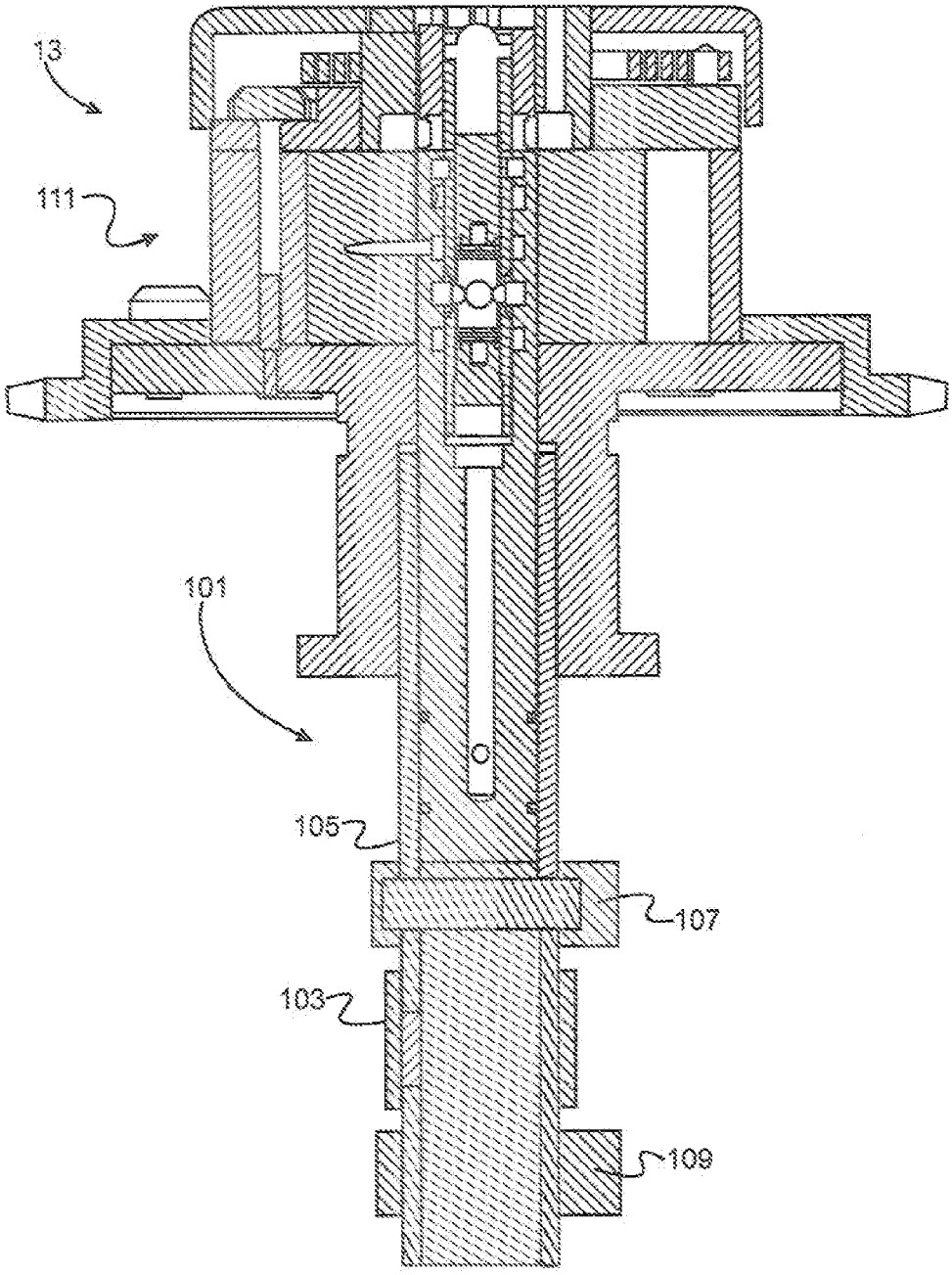
FIG. 2 is a diagrammatic view of a concentric cam phaser device for use in the system of FIG. 1 according to another variation of the invention.

Referring now to FIG. 2, the engine 12 may include any suitable variable valve timing devices to actuate the exhaust valves 24, 25. In one example, individual actuators such as solenoids (not shown) may be used to actuate the exhaust valves 24, 25. In another example, a dual acting concentric cam device 13 may be used to actuate each of the exhaust valves 24, 25 independently of the other. The device 13 may include a camshaft assembly 101 that may include concentric shafts including a cam shaft 103 carried by a cam tube 105. The cam shaft 103 carries blowdown or scavenging valve cams 107, 109 and the cam tube 105 carries the other of the blowdown or scavenging valve cams 107, 109. In one variation, the shaft or tube coupled to the blowdown valve cams may be of fixed phase relationship with respect to an engine crankshaft and another concentric shaft coupled to the scavenging valves may be of variable phase relationship with respect to the engine crankshaft varied by a cam phaser 111. In another variation, offering somewhat greater performance and efficiency, one or more cam phasers 111 may vary the phase relationship of the cam shaft 107 and tube 109 independently with respect to one another and with respect to the engine crankshaft. The timing and/or lift of the exhaust valves may be controlled by adjusting the phase or angle between the cam shaft 107 and tube 109 with the phaser(s) 111.

The cam device 13 may be controlled by the control subsystem 16, such as an engine electronic control module, based on engine testing and calibration to produce good engine emissions and efficiency at all speeds and loads. The cam device 13 may be the primary device in conjunction with the exhaust valves 24, 25 to vary energy delivered to the turbocharger turbine and thus control turbocharger boost without need for a turbo wastegate device. In another variation, various materials described herein may also be used with systems without a turbocharger. In other select variations, the methods described herein may be used with engine breathing systems including a supercharger, a precharger, a variable geometry turbocharger and/or a multistage turbocharger.

In general, optimal valve timing of blowdown and scavenging valves will be application specific and, thus, will vary from engine to engine. But, the blowdown valves 24 may have relatively advanced timing, have longer valve opening duration, with higher lift than the scavenging valves 25. In one example, the lift of the blowdown valves 24 may be the maximum lift attainable in approximately 180 degrees of crank angle, and the lift of the scavenging valves 25 may be the maximum lift attainable in approximately 160 degrees of crank angle.

Illustrative valve timing including duration and/or lift for the blowdown valve(s) 24 may be on the order of about 70 to 100% of valve timing for the same or similar engine equipped with conventional exhaust valves. More specific exemplary valve timing for the blowdown valve(s) 24 may be about 85-95% (e.g. 90%) duration and about 90-100% (e.g. 95%) lift of valve duration and lift timing for the same or similar engine equipped with conventional exhaust valves. Valve opening timing of the blowdown valve(s) 24 generally may be similar to or retarded at minimum turbocharger boost condition, and advanced to increase boost. Illustrative phase authority for the cam device 13 for the blowdown valve(s) 24 may be on the order of about 25 to 40 degrees (e.g. 28 degrees) of crankshaft angle between about 2000 and 5500 RPM.

Illustrative valve timing including duration and/or lift for the scavenging valve(s) 25 may be on the order of about 60 to 90% of valve timing for the same or similar engine equipped with conventional exhaust valves. More specific variations of valve timing for the scavenging valve(s) 25 may be about 75-85% (e.g. 80%) duration and about 80-90% (e.g. 85%) lift of valve duration and lift timing for the same or similar engine equipped with conventional exhaust valves. Valve closing timing of the scavenging valve(s) 25 generally may be similar to valve closing timing of the same or similar engine equipped with conventional exhaust valves. Illustrative phase authority for the cam device 13 for the scavenging valve(s) 25 may be on the order of about 30 to 90 degrees (e.g. 60 degrees) of crankshaft angle between about 2000 and 5500 RPM.

Referring to FIG. 1*a*, the engine breathing system 14 may include an induction subsystem 26 that may compress and cool induction gases and convey them to the engine 12 and an exhaust subsystem 28 that may extract energy from exhaust gases and carry them away from the engine 12. The engine breathing system 14 may also include an exhaust gas recirculation (EGR) subsystem 30 in communication across the exhaust and induction subsystems 26, 28 to recirculate exhaust gases for mixture with fresh air to reduce emissions and pumping losses from the engine system 10. The engine breathing system 14 may further include a turbocharging system 32 between the induction and exhaust subsystems 26, 28 to compress inlet air and thereby improve combustion to increase engine power output. As used herein, the phrase induction gases may include fresh air, compressed air, and/or recirculated exhaust gases.

One variation may include a turbocharging subsystem 32 that may be a single stage system, as shown, or may be a multi-stage or sequential turbocharging subsystem. The turbocharging subsystem 32 may include a turbine side 34 in the exhaust subsystem 28 and a compressor side 36 in the induction subsystem 26. Multi-stage turbocharging may allow for continuously variable adaptation of the turbine and compressor sides 34, 36 of the subsystem 32 over most or all engine operating points. The turbocharging subsystem 32 may include one, two, or more turbochargers of any size and type, that may be connected in series, parallel, or both, and that may or may not use wastegate valving or bypass regulation. In other words, the subsystem 32 may also include any suitable compressor and/or turbine bypass or wastegate valves of any suitable type. But it is contemplated that the method and apparatus disclosed herein will reduce or eliminate need for turbine bypass valves.

A select variation of a turbocharging subsystem 32 may include a first turbocharger 38. The turbocharger 38 may be of variable turbine geometry (VTG) type of turbochargers, dual-stage turbochargers, or turbochargers with wastegate or bypass devices, or the like. Although VTG turbochargers tend to cause increased backpressure and concomitant reduced fuel economy in engines equipped with conventional exhaust systems, VTG turbochargers may be more efficient when used with a divided exhaust engine such as engine 12. This is because pumping mean effective pressure (PMEP) penalties, due to pumping parasitic losses, at small nozzle openings may be greatly reduced when turbine energy is delivered by the blowdown exhaust valve path because exhaust backpressure acting on engine pistons during exhaust are typically minimally affected by high backpressure at a turbocharger turbine inlet. In any case, the turbocharger 38 and/or any turbocharger accessory device(s) may be adjusted to affect any one or more of the following exemplary parameters: turbocharger boost pressure, air mass flow, and/or EGR flow.

In one variation the turbocharger 38 may include a turbine 42 and a compressor 44 mechanically coupled to the turbine 42.

In select variations the induction subsystem 26 may include, in addition to suitable conduit and connectors, an inlet end 50 which may have an air filter 52 to filter incoming air. The induction subsystem 26 may also include a charge air cooler 54 downstream of the turbocharger compressor 44 to cool the compressed air, and an intake throttle valve 56 downstream of the charge air cooler 54 to throttle the flow of the cooled air to the engine 12. The induction subsystem 26 also may include an intake manifold 58 downstream of the throttle valve 56 and upstream of the engine 12, to receive the throttled air and distribute it to the engine combustion chambers 20. The induction subsystem 26 may also include any other suitable devices.

In select variations the exhaust subsystem 28 may include, in addition to suitable conduit and connectors, an exhaust manifold 60 to collect exhaust gases from the combustion chambers 20 of the engine 12 and convey them downstream to the rest of the exhaust subsystem 28. The exhaust manifold 60 may include a first or blowdown exhaust manifold 62 in communication with the blowdown exhaust valves 24, and a scavenging exhaust manifold 63 in communication with the scavenging exhaust valves 25. The exhaust manifold 60 may be separate from, or integrated with, the cylinder head (not separately shown). The blowdown and scavenging exhaust manifolds 62, 63 may be separate, or integrated with one another.

In one variation the exhaust subsystem 16 also may include one or both of the turbocharger turbine 42 in downstream communication with the exhaust manifold 60 and, more particularly, with the blowdown manifold 62. The exhaust subsystem 28 may also include any quantity of suitable emissions devices, such as emission device(s) downstream of the exhaust manifold 60. The emission device(s) may include one or more catalytic converters like a close-coupled diesel oxidation catalyst (DOC) device, a nitrogen oxide (NOx) absorber unit, a particulate filter, and/or the like. One more variable restriction valves 65, such as backpressure valve(s), may be located in communication with the scavenging exhaust manifold 63 before and/or after emissions device 64 to enable increases in exhaust energy delivered to the turbocharger turbine 42 at low engine speed. The exhaust subsystem 28 may also include any other suitable devices.

In select variations the EGR subsystem 30 may recirculate portions of the exhaust gases from the exhaust subsystem 28 to the induction subsystem 26 for combustion in the engine 12. In one variation, as shown, the EGR subsystem 30 may include a low pressure (LP) EGR path 80 connected to the exhaust subsystem 28 upstream of the turbocharger turbine 42 but connected to the induction subsystem 26 downstream of the turbocharger compressor 44. Cylinder 20*a* is a dedicated EGR cylinder and may recirculate high and low pressure exhaust gas back to the induction subsystem 14 through blowdown and scavenging valves 24, 25.

In select variations, the dedicated cylinder 20*a* may be running at a different air/fuel ratio than the other cylinders 20. The air/fuel ratio at the cylinders 20 and 20*a* may be adjusted as needed during the operation of the engine.

The variation illustrated in FIG. 1A shows proportional valve 66 in conduit 70 leading from dedicated cylinder 20*a* to the air charge cooler 54 and proportional valve 67 in conduit 82 leading from the conduit 70 to the blowdown manifold 62.

Additionally a proportional EGR valve 61 may be provided in the low pressure EGR line 80.

In operation of select variations, proportional EGR valve may be varied to allow varying amounts of high pressure exhaust valve in to the intake system upstream of the compressor 44.

In one variation for normal operations where sufficient boost can be supplied from the non-dedicated cylinders the system supplies 25% EGR from the rich dedicated cylinder wherein valve 67 is close and valve 66 is open.

In one variation, the scavenging manifold may supplement through low pressure line 80 may supplement the EGR rate through by modulating EGR valve 67. Scavenging EGR may also be delivered directly to the intake manifold.

In one variation, for operation at high load and low engine speed dedicated cylinder 20*a* can be changed from a rich gas mixture to a stoichiometric gas mixture. Additionally, valve 67 can be opened to allow some of the exhaust gas from dedicated cylinder 20*a* to enter the blowdown manifold to increase turbine 42 spin. EGR valve 67 may be modulated to provide the desired EGR rate. Boost may also be adjusted by modifying the cam phase of the scavenging valves.

Figure 1B:
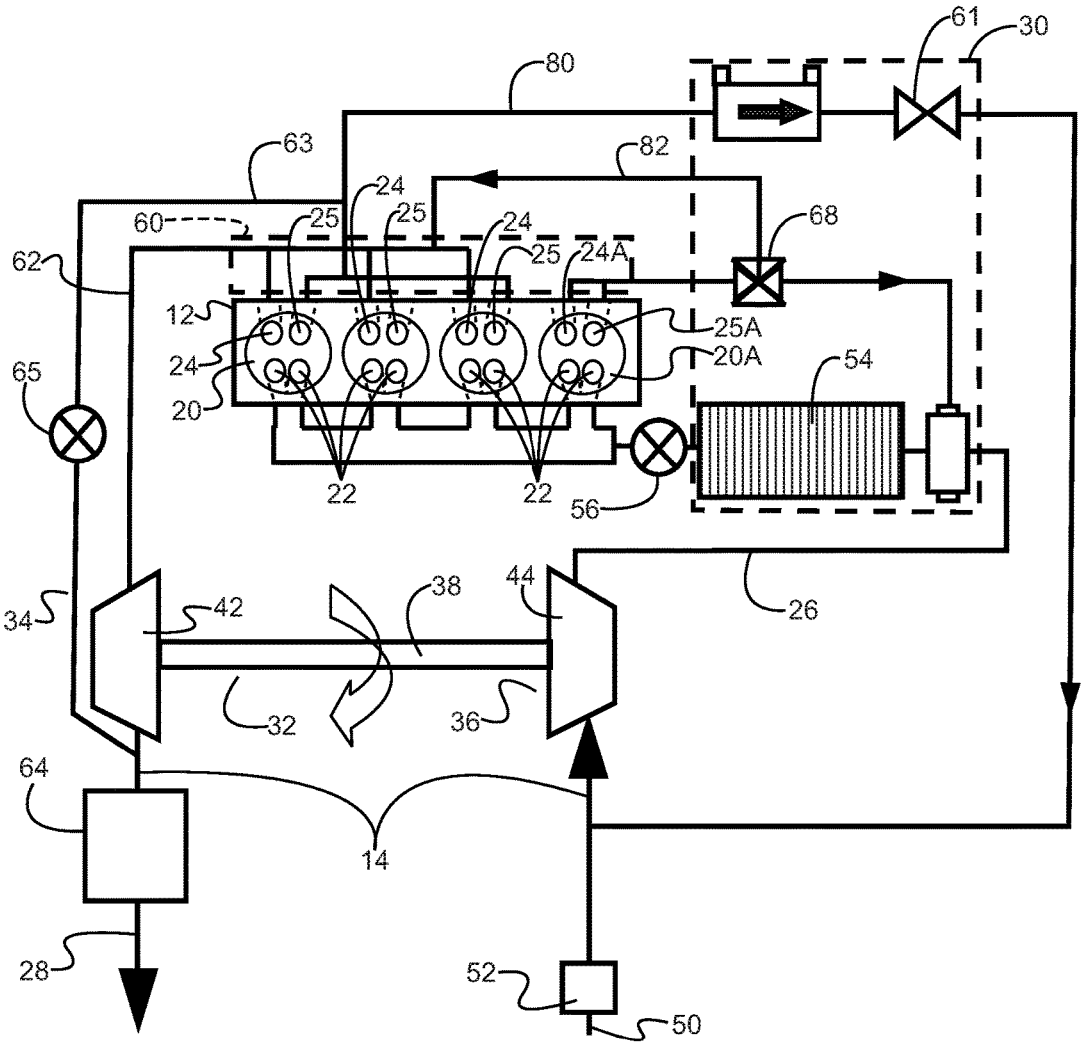
FIG. 1*b* is a schematic view of an internal combustion engine system according to another variation of the invention.

The variation illustrated in FIG. 1B is similar except that valves 66 and 67 are replaced with a multiway or three way valve 68 that can control the flow of exhaust gas from the dedicated cylinder 20*a* through the EGR and as additional boost.

Figure 1C:
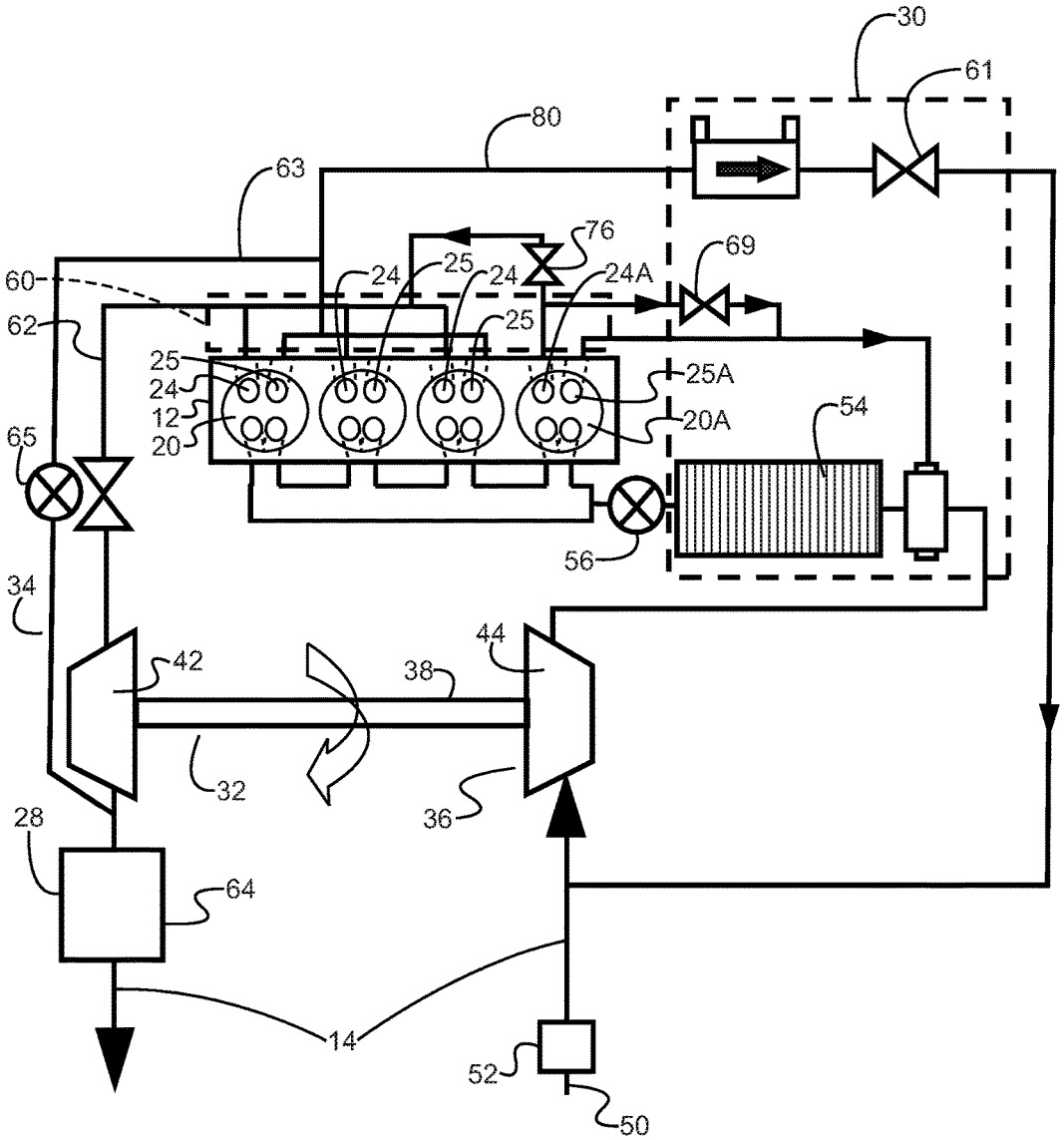
FIG. 1*c* is a schematic view of an internal combustion engine system according to another variation of the invention.

FIG. 1C illustrates another variation wherein the scavenging valve of the dedicated cylinder 25*a* may be dedicated to the EGR system and multiple valves 69 and 76 control the flow of exhaust gas from blowdown valve of the dedicated cylinder 24*a* between the EGR system and providing additional boost valves 69 and 76 may be replaced by a single three-way or multiway valve (not shown) as was the case in the variation illustrated in FIG. 1B.

In one variation, for normal EGR operation, where sufficient boost can be supplied from the other stoichiometric cylinders 25% EGR is supplied from the rich dedicated cylinder 20*a* and valve 76 is close and valve 69 is open.

In one variation, the low pressure line 80 may supplement EGR with HC-rich EGR from the scavenging manifold and valve 61 may be modulated to control the flow scavenge EGR could alternately be delivered to the intake manifold.

In one variation for operation at high load, and/or low engine speed, exhaust energy from the dedicated cylinders' blow down port 24*a* may be used to increase energy to the turbine. This may be accomplished by switching the rich dedicated cylinder 20*a* to stoichiometric; opening valve 76; modulating or closing valve 69; modulating valves 61 and 69 to deliver the appropriate EGR rate; and/or adjusting the boost with the scavenge cam phase and valve 69 position.

In select variations, the control subsystem 16 may include any suitable hardware, software, and/or firmware to carry out at least some portions of the methods disclosed herein below. For example, the control subsystem 16 may include various engine system actuators and sensors (not shown).

The engine system sensors are not individually shown in the drawings but may include any suitable devices to monitor engine system parameters. For example, an engine speed sensor may measure the rotational speed of an engine crankshaft (not shown), pressure sensors in communication with the engine combustion chambers 20 may measure engine cylinder pressure, intake and exhaust manifold pressure sensors may measure pressure of gases flowing into and away from the combustion chambers 20, an inlet air mass flow sensor may measure incoming airflow in the induction subsystem 26, and an intake manifold mass flow sensor may measure flow of induction gases to the engine 12. In another variation, temperature sensors may measure the temperature of induction gases flowing to the engine 12. In a further variation, the engine system 10 may include a speed sensor suitably coupled to the turbocharger 38 to measure the rotational speed thereof. A throttle position sensor, such as an integrated angular position sensor, may measure the position of the throttle valve 56. A position sensor may be disposed in proximity to the turbocharger 38 to measure the position of VTG blades if provided. A tailpipe temperature sensor may be placed just upstream of a tailpipe outlet to measure the temperature of the exhaust gases exiting the exhaust subsystem. Also, temperature sensors may be placed upstream and downstream of the emissions device(s) to measure the temperature of exhaust gases at the inlet(s) and outlet(s) thereof. Similarly, one or more pressure sensors may be placed across the emissions device(s) to measure the pressure drop thereacross. An oxygen ($O_2$) sensor may be placed in the exhaust and/or induction subsystems to measure oxygen in the exhaust gases and/or induction gases. Finally, position sensors may measure the positions of the EGR valves.

In addition to the sensors discussed herein, any other suitable sensors and their associated parameters may be encompassed by the presently disclosed system and methods. For example, the sensors may also include accelerator sensors, vehicle speed sensors, powertrain speed sensors, filter sensors, other flow sensors, vibration sensors, knock sensors, intake and exhaust pressure sensors, and/or the like. In other words, any sensors may be used to sense any suitable physical parameters including electrical, mechanical, and chemical parameters. As used herein, the term sensor may include any suitable hardware and/or software used to sense any engine system parameter and/or various combinations of such parameters.

The control subsystem 16 may further include one or more controllers (not separately shown) in communication with the actuators and sensors for receiving and processing sensor input and transmitting actuator output signals. The controller(s) may include one or more suitable processors and memory devices (not separately shown). The memory may be configured to provide storage of data and instructions that provide at least some of the functionality of the engine system 10 and that may be executed by the processor(s). At least portions of the method may be enabled by one or more computer programs and various engine system data or instructions stored in memory as look-up tables, formulas, algorithms, maps, models, or the like. In any case, the control subsystem 16 may control engine system parameters by receiving input signals from the sensors, executing instructions or algorithms in light of sensor input signals, and transmitting suitable output signals to the various actuators. As used herein, the term "model" may include any construct that represents something using variables, such as a look up table, map, formula, algorithm and/or the like. Models may be application specific and particular to the exact design and performance specifications of any given engine system.

Figure 3:
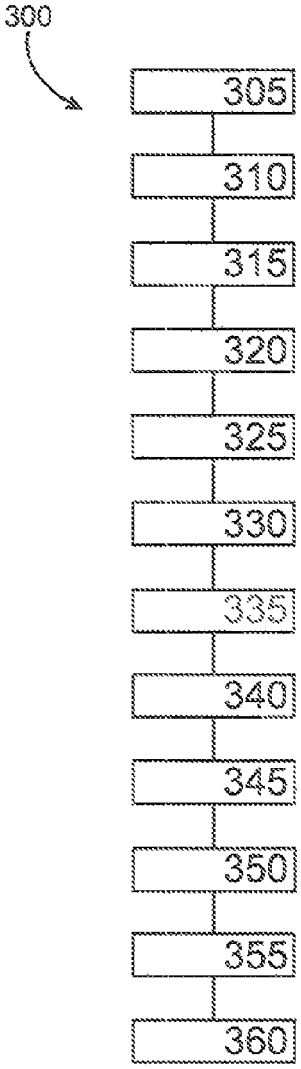
FIG. 3 is a flow chart of a method of controlling exhaust gas flow divided between at least one turbocharger and at least one exhaust gas recirculation path of the system of FIG. 1 according to another variation of the invention.

One variation of the invention may include a method of controlling EGR which may be carried out as one or more computer programs within the operating environment of the engine system 10 described above. Those skilled in the art will also recognize that a method according to any number of variations of the invention may be carried out using other engine systems within other operating environments. Referring now to FIG. 3, a select variation may include a method 300 illustrated in flow chart form. As the description this particular variation of the method 300 progresses, reference will be made to the engine system 10 of FIG. 1*a*-1*c* having a turbocharged engine with multiple cylinders, each cylinder with divided exhaust gas flow between blowdown and scavenging exhaust valves, at least one cylinder dedicated to an exhaust gas recirculation (EGR) subsystem, and at least one cylinder connected to an exhaust subsystems in communication with the engine and having an induction system.

As shown at step 305, the method may start by communicating at least one blowdown exhaust valve from at least one cylinder connected to the exhaust subsystem to the exhaust subsystem via a blowdown manifold.

At step 310, the scavenger valve of the at least one cylinder connected to the EGR system may communicate to the EGR subsystem.

At step 315, the EGR subsystem may communicate to the induction system.

At step 320, the method may also include providing a first valve in fluid communication between the EGR subsystem and the induction'

At step 325, the method may also include providing a second valve in fluid communication between at least the blowdown valve of the dedicated EGR cylinder and the blowdown manifold.

At step 330, the method may include providing a third valve between the scavenging manifold and the induction subsystem.

At step 335, the method may also include wherein the first valve is open and the second valve is closed to supplement additional EGR.

At step 340, the method wherein the second valve is open and the first valve is modulated to create additional turbine boost.

At step 345, the method may also include wherein the engine is provided with a cam phaser for the scavenging valves, and boost is adjusted by adjusting the cam phaser.

At step 350, the method may also include providing a multi-way valve in fluid communication between the EGR subsystem, the blowdown manifold and the induction.

At step 355, the method may also include wherein the scavenging valve of the dedicated cylinder is in direct communication with the air induction subsystem and a valve is provided in fluid communication with the blowdown valve of the dedicated EGR cylinder and the EGR subsystem wherein the valve can be modulated to modify EGR rate.

At step 360, the method may also include wherein the scavenging valve of the dedicated cylinder is in direct communication with the air induction subsystem and a valve is provided in fluid communication with the blowdown valve of the dedicated EGR cylinder and the blowdown manifold wherein the valve can be modulated to modify boost.

At step 365, the method may also include wherein the scavenging valve of the dedicated cylinder is in direct communication with the air induction subsystem and a multi-way valve is provided in fluid communication with the blowdown valve of the dedicated EGR cylinder, the blowdown manifold, and the EGR subsystem wherein the valve can be modulated to modify boost and EGR rate.

Although the term "step" is used herein, such is not intended to limit the invention to specific components, elements or act described herein.

The method 300 or any portion thereof may be performed as part of a product such as the system 10 of FIG. 1, and/or as part of a computer program that may be stored and/or executed by the control subsystem 16. The computer program may exist in a variety of forms both active and inactive. For example, the computer program may exist as software program(s) comprised of program instructions in source code, object code, executable code or other formats; firmware program(s); or hardware description language (HDL) files. Any of the above may be embodied on a computer usable medium, which include storage devices and signals, in compressed or uncompressed form. Illustrative computer usable storage devices include conventional computer system RAM (random access memory), ROM (read only memory), EPROM (erasable, programmable ROM), EEPROM (electrically erasable, programmable ROM), and magnetic or optical disks or tapes.

The following descriptions of number variations are illustrative and are not intended to limit the scope of the invention.

Variation 1 may include a method of controlling an internal combustion engine system, including communicating at least one blowdown exhaust valve from at least one cylinder connected to the exhaust subsystem to the exhaust subsystem via a blowdown manifold; communicating the scavenger valve of the at least one cylinder connected to the EGR system to the EGR subsystem; and communicating the EGR subsystem to the induction system Variation 2 may include the method of variation 1 further comprising providing a first valve in fluid communication between the EGR subsystem and the induction.

Variation 3 may include the method of variations 1-2 further comprising providing a second valve in fluid communication between at least the blowdown valve of the dedicated EGR cylinder and the blowdown manifold.

Variation 4 may include the method of variations 1-3 further comprising providing a third valve between the scavenging manifold and the induction subsystem.

Variation 5 may include the method of variations 1-4 wherein the first valve is open and the second valve is closed to supplement additional EGR.

Variation 6 may include the method of variations 1-4 wherein the second valve is open and the first valve is modulated to create additional turbine boost.

Variation 7 may include the method of variations 1-6 wherein the engine is provided with a cam phaser for the scavenging valves, and boost is adjusted by adjusting the cam phaser.

Variation 8 may include the method of variations 1-7 further comprising providing a multi-way valve in fluid communication between the EGR subsystem, the blowdown manifold and the induction.

Variation 9 may include the method of variations 1-8 wherein the scavenging valve of the dedicated cylinder is in direct communication with the air induction subsystem and a valve is provided in fluid communication with the blowdown valve of the dedicated EGR cylinder and the EGR subsystem wherein the valve can be modulated to modify EGR rate.

Variation 10 may include the method of variations 1-9 wherein the scavenging valve of the dedicated cylinder is in direct communication with the air induction subsystem and a valve is provided in fluid communication with the blowdown valve of the dedicated EGR cylinder and the blowdown manifold wherein the valve can be modulated to modify boost.

Variation 11 may include the method of variations 1-10 wherein the scavenging valve of the dedicated cylinder is in direct communication with the air induction subsystem and a multi-way valve is provided in fluid communication with the blowdown valve of the dedicated EGR cylinder, the blowdown manifold, and the EGR subsystem wherein the valve can be modulated to modify boost and EGR rate.

Variation 12 may include an internal combustion engine system, comprising having an internal combustion engine including a plurality of cylinders, each having a blowdown exhaust valve and a scavenging exhaust valve wherein at least one cylinder is dedicated to an EGR subsystem and at least one cylinder is connected to an exhaust subsystem to carry exhaust gases away from the engine; an induction subsystem to deliver induction gases to the engine wherein the exhaust subsystem carries exhaust gases away from the engine, and including a blowdown exhaust manifold in communication with the blowdown exhaust valves of the cylinders connected to the exhaust subsystem, and a scavenging exhaust manifold in communication with the scavenging exhaust valves of the cylinders connected to the exhaust subsystem; and an exhaust gas recirculation (EGR) subsystem in communication with at least the scavenging valve of the dedicated EGR cylinder, the EGR subsystem in communication with the induction subsystem.

Variation 13 may include the system of variations 12, further comprising a first valve between the dedicated cylinder and the induction subsystem.

Variation 14 may include the system of variations 12-13 further comprising a second valve in communication between the dedicated cylinder and the blowdown manifold.

Variation 15 may include the system of variations 12-14, further comprising a third valve in communication with the scavenging exhaust manifold and the induction subsystem upstream of the compressor.

Variation 16 may include the system of variations 12-15, wherein the EGR valve is at least one of a three-way or a four-way EGR valve.

Variation 17 may include the system of variations 12-16, wherein the blowdown valve of the dedicated cylinder is in communication with the blowdown manifold.

Variation 18 may include the system of variations 12-17 further comprising a valve in the blowdown manifold upstream of the turbine.

Variation 19 may include the system of variation 12-18 wherein the scavenging exhaust manifold is in communication with the exhaust subsystem downstream of the turbine.

Variation 20 may include the system of variations 12-19 wherein the engine also includes a concentric cam device to vary timing of the exhaust valves and including a cam shaft carried by a cam tube, wherein the cam shaft carries blowdown or scavenging valve cams and the cam tube carries the other of the blowdown or scavenging valve cams, and at least one cam phaser to vary a phase relationship of the cam tube and shaft with respect to the engine crankshaft.

Variation 21 may include the system of variations 20, wherein the at least one cam phaser varies the phase relationship of the cam shaft and tube independently with respect to one another and with respect to the engine crankshaft.

The above description of variations of the invention is merely exemplary in nature and, thus, variations thereof are not to be regarded as a departure from the spirit and scope of the invention.

What is claimed is:

1. A method of controlling an internal combustion engine system, which includes an engine with multiple cylinders, each cylinder with divided exhaust gas flow between blowdown and scavenging exhaust valves, at least one cylinder dedicated to an exhaust gas recirculation (EGR) subsystem, and at least one cylinder connected to an exhaust subsystem in communication with the engine and having an induction subsystem, the method comprising:

communicating at least one blowdown exhaust valve from at least one cylinder connected to the exhaust subsystem via a blowdown manifold;

communicating the scavenging exhaust valve of the at least one cylinder connected to the EGR subsystem;

communicating the EGR subsystem to the induction subsystem; and wherein the scavenging valve of the dedicated EGR cylinder is in direct communication with the induction subsystem and a valve is provided in fluid communication with the blowdown valve of the dedicated EGR cylinder, the EGR subsystem, and the blowdown manifold wherein the valve can be modulated to modify boost.

2. The method of claim 1 further comprising providing a first valve in fluid communication between the EGR subsystem and the induction subsystem.

3. The method of claim 2 further comprising providing a second valve in fluid communication between at least the blowdown valve of the dedicated EGR cylinder and the blowdown manifold.

4. The method of claim 3 further comprising a scavenging manifold in the exhaust subsystem, and providing a third valve between the scavenging manifold and the induction subsystem.

5. The method of claim 4 wherein the first valve is open and the second valve is closed to supplement additional EGR.

6. The method of claim 4 wherein the second valve is open and the first valve is modulated to create additional turbocharger boost.

7. The method of claim 6 wherein the engine is provided with a cam phaser for the scavenging valves, and boost is adjusted by adjusting the cam phaser.

8. The method of claim 1 further comprising providing a multi-way valve in fluid communication between the EGR subsystem, the blowdown manifold and the induction subsystem.

9. The method of claim 1 wherein the valve is a multi-way valve and can be further modulated to modify EGR rate.

10. A method of controlling an internal combustion engine system, which includes an engine with multiple cylinders, each cylinder with divided exhaust gas flow between blowdown and scavenging exhaust valves, at least one cylinder dedicated to an exhaust gas recirculation (EGR) subsystem, and at least one cylinder connected to an exhaust subsystem in communication with the engine and having an induction subsystem, the method comprising:

communicating at least one blowdown exhaust valve from at least one cylinder connected to the exhaust subsystem via a blowdown manifold;

communicating the scavenging exhaust valve of the at least one cylinder connected to the EGR subsystem; and communicating the EGR subsystem to the induction subsystem;

wherein the scavenging exhaust valve of the dedicated EGR cylinder is in direct communication with the induction subsystem and a valve is provided in fluid communication with the blowdown valve of the dedicated EGR cylinder and the blowdown manifold wherein the valve can be modulated to modify boost.

11. An internal combustion engine system, comprising:

an internal combustion engine including a plurality of cylinders, each having a blowdown exhaust valve and a scavenging exhaust valve wherein at least one cylinder is dedicated to an EGR subsystem and at least one cylinder is connected to an exhaust subsystem to carry exhaust gases away from the engine;

an induction subsystem to deliver induction gases to the engine;

wherein the exhaust subsystem carries exhaust gases away from the engine, and including a blowdown exhaust manifold in communication with the blowdown exhaust valves of the cylinders connected to the exhaust subsystem, and a scavenging exhaust manifold in communication with the scavenging exhaust valves of the cylinders connected to the exhaust subsystem;

an exhaust gas recirculation (EGR) subsystem in communication with at least the scavenging valve of the dedicated EGR cylinder, the EGR subsystem in communication with the induction subsystem; and wherein the scavenging valve of the dedicated EGR cylinder is in direct communication with the induction subsystem and a valve is provided in fluid communication with the blowdown valve of the dedicated EGR cylinder and the blowdown manifold wherein the valve can be modulated to modify boost.

12. The system of claim 11, further comprising a first valve between the dedicated EGR cylinder and the induction subsystem.

13. The system of claim 12 further comprising a second valve in communication between the dedicated EGR cylinder and the blowdown manifold.

14. The system of claim 11, further comprising a third valve in communication with the scavenging exhaust manifold and the induction subsystem upstream of the compressor.

15. The system of claim 11, comprising an EGR valve between the dedicated EGR cylinder and the induction subsystem, wherein the EGR valve is at least one of a three-way or a four-way EGR valve.

16. The system of claim 11, wherein the blowdown valve of the dedicated EGR cylinder is in communication with the blowdown manifold.

17. The system of claim 11 further comprising a valve in the blowdown manifold upstream of the turbine.

18. The system of claim 11 wherein the scavenging exhaust manifold is in communication with the exhaust subsystem downstream of the turbine.

19. The system of claim 11 wherein the engine also includes a concentric cam device to vary timing of the exhaust valves and including a cam shaft carried by a cam tube, wherein the cam shaft carries blowdown or scavenging valve cams and the cam tube carries the other of the blowdown or scavenging valve cams, and at least one cam phaser to vary a phase relationship of the cam tube and shaft with respect to the engine crankshaft.

20. The system of claim 19, wherein the at least one cam phaser varies the phase relationship of the cam shaft and tube independently with respect to one another and with respect to the engine crankshaft.

21. The system of claim 19 further comprising a turbocharging subsystem including a compressor operatively connected to turbine in communication with the blowdown exhaust manifold.

* * * * *